US005907347A

United States Patent [19]

Nagahata et al.

[11] Patent Number: 5,907,347

[45] Date of Patent: May 25, 1999

[54] LINEAR THERMAL PRINT HEAD AND LINEAR THERMAL PRINT HEAD APPARATUS

[75] Inventors: Takaya Nagahata; Tadayoshi Sato, both of Kyoto, Japan

[73] Assignee: Rohm Co., Ltd., Kyoto, Japan

[21] Appl. No.: 08/860,775

[22] PCT Filed: Jul. 30, 1996

[86] PCT No.: PCT/JP96/02152

§ 371 Date: Jul. 7, 1997

§ 102(e) Date: Jul. 7, 1997

[87] PCT Pub. No.: WO97/04965

PCT Pub. Date: Feb. 13, 1997

[30] Foreign Application Priority Data

Jul. 31, 1995 [JP] Japan ..... 7-194499
Aug. 2, 1995 [JP] Japan ..... 7-197575

[51] Int. Cl.[6] ..... B41J 2/335; B41J 2/345

[52] U.S. Cl. ..... 347/208

[58] Field of Search ..... 347/200, 208, 347/209

[56] References Cited

U.S. PATENT DOCUMENTS 5,278,580 1/1994 Nishikawa et al. .
5,335,002 8/1994 Nagahata et al. ..... 347/209
5,568,174 10/1996 Nagahata et al. ..... 347/200

FOREIGN PATENT DOCUMENTS 58-205780 11/1983 Japan .
62-32058 8/1985 Japan .
2-1420369 11/1990 Japan .
2-286261 11/1990 Japan .
6-246948 2/1993 Japan .
6-267620 3/1993 Japan .
5-177862 7/1993 Japan .
6-135036 5/1994 Japan .

*Primary Examiner*—Huan Tran
*Attorney, Agent, or Firm*—Fish & Richardson P.C.

[57] ABSTRACT

A linear thermal print head used for a printer, for such as a facsimile, and formed so as to improve the quality of a printed product by reducing density differences of parts of a printed product. An ease with which to fix the linear thermal print head and a head connector to each other is improved. A heating resistor (2), a common wiring pattern (3), individual writing patterns (4), driving circuit elements (5) and a ground wiring pattern (7) are provided in a linearly extending manner on a surface of a head base plate (1). A ground writing pattern connecting terminal (8), which is electrically connected to a substantially longitudinally intermediate portion of the ground writing pattern, is provided on the portion of the surface of the head base plate which is at a substantially intermediate part of a ground writing pattern side edge region thereof. A pair of common wiring pattern connecting terminals (12, 13) which are electrically connected to both ends of the common wiring pattern are provided on both of the other sides of the ground writing pattern connecting terminal.

7 Claims, 10 Drawing Sheets

LINEAR THERMAL PRINT HEAD AND LINEAR THERMAL PRINT HEAD APPARATUS

BACKGROUND OF THE INVENTION

1. Technical Field

The present invention relates to a line type thermal print for printing in a facsimile or the like, the line type thermal print head comprising a heating resistor and circuit patterns corresponding to respective portions of the heating resistor.

Also, the present invention relates to line type thermal print head device, including the above mentioned line type thermal print head and a head connector which is mounted on the print head in such a manner as to conduct to each of the connection terminals of the line type thermal print head.

2. Background Art (1) Line Type Thermal Print Head

Generally, a thermal print head of this type has a rectangular head circuit board and a heating resistor formed in a straight line in the longitudinal direction (line-direction) of the circuit board. A common wiring pattern is formed so as to extend in parallel with the heating resistor along one side edge in the longitudinal direction of the surface of the head circuit board, and the common wiring conducts to those portions of the heating resistors which correspond to the respective print dots. Further, a plurality of individual circuits are formed in the area opposite to the common wiring across the heating resistor on the surface of the head circuit board. The individual circuits conduct to those portions of the heating resistor which correspond to the respective dots. Further, a ground wiring pattern is formed so as to extend in the longitudinal direction of the surface of the head circuit board, and a plurality of driver elements are mounted on the head circuit board which connect the ground wiring to the individual circuits.

When each driver element switches from one circuit to another under the condition that the line type thermal print head is mounted in the printer of a facsimile or the like, an arbitrary individual circuit electrically conducts to the ground wiring. Accordingly, the portion of the heating resistor which corresponds to the currently conducting individual circuit generates heat, so that printing takes place at the print dot according to the amount of heat generated.

The ground wiring and the common wiring in the line type thermal print head extend along the linear heating resistor. Both wiring patterns are connected to a power source so as to have electrical power supplied at one end or both ends thereof. Since both wiring patterns are thin and long and narrow, it is difficult to reduce the electrical resistance of both wiring patterns. Therefore, under this arrangement, there is a voltage drop along the longitudinal direction of each wiring pattern. Owing to the voltage drop, a difference in density occurs in the printed dots.

Japanese Patent Laid-Open Publication No. Hei 2-286261 (Japanese Patent Publication No. Hei 4-17797) proposes a line type thermal print head developed to solve the above-mentioned problem (Related Art 1). FIG. 12 shows the outline of this line type thermal print head. In FIG. 12, reference numeral 201 denotes a head circuit board, 202 a heating resistor, 203 a common wiring pattern, 205 driver elements, and 207 a ground wiring pattern, with no individual circuits depicted. As shown in FIG. 12, the ground wiring pattern 207 is divided substantially at the center of the head circuit board 201 into a right-side ground wiring pattern 207*a* and a left-side ground wiring pattern 207*b*. A pair of ground connection terminals 208 and a pair of common-wiring connection terminals 212 are formed close to the longitudinal side edge 201*b* and substantially in the central area in the longitudinal direction of the head circuit board 201. The pair of common-wiring connection terminals 212 are located more towards the inside than the pair of ground connection terminals 208. The pair of ground connection terminals conduct to the pair of ground wiring patterns, respectively, while the common-wiring connection terminals conduct to both ends of the common wiring pattern 203.

In Related Art 1, the voltage drop in the common wiring pattern 203 becomes larger as one moves from either side toward the center area, and the voltage drop in the pair of ground wiring patterns becomes larger as one moves toward either side. Therefore, the voltage between the common wiring pattern 203 and each of the pair of the ground wiring patterns 207 is maintained substantially at a fixed level along the longitudinal direction of the head circuit board 201, so that the difference in printing density resulting from the voltage drop is small.

However, with the arrangement of Related Art 1 that the ground wiring pattern 207 is divided into a right-side pattern 207*a* and a left-side pattern 207*b*, there is a problem. In a case where printing is carried out using this thermal line type thermal print head, it sometimes happens that the number of dots in printing with the right-side ground wiring pattern 207*a* differs from the number of dots in printing with the left-side ground wiring pattern 207*b*. In this case, a voltage difference occurs between the ground wiring pattern in which more dots are used and the ground wiring pattern in which less dots are used. For example, this voltage difference can be expressed as a difference between representative voltage values of both ground wiring patterns, the representative value being a voltage at the center of each ground wiring pattern. This voltage difference at times causes a density difference between printing by one ground wiring pattern and printing by the other ground wiring pattern.

Another problem with Related Art 1 is as follows. In Related Art 1, both common-wiring connection terminals 212 are located more towards in the inner positions than the ground connection terminals 208. Between each ground connection terminal 208 and the side edge 201*b* of the head circuit board 201, there is the common-wiring connection circuit 211 to connect both ends of the common-wiring pattern 203 to both common-wiring connection terminals 212. Because of this structural restriction, it is impossible to arrange the circuits so that both ground connection terminals 208 extend up to the side edge 201*b* of the head circuit board 201. In order to connect external wires (or the connector for external wires) to both ground connection terminals 208, it is necessary to arrange such a connection circuitry to go beyond the common-wiring connection terminals 211. It is required to do away with such a complicated connection, and facilitate connection of various kinds of external wires to the ground connection terminals 208.

(2) Line Type Thermal Print Head Assembly

The line type thermal print head assembly is a system having a head connector mounted to the line type thermal print head. The head connector is mounted so as to conduct to the connection terminals of the line type thermal print head. External wires (or the terminal connector of external wires) are connected to the head connector.

In most cases, the head connector is conventionally mounted to the side edge of the line type thermal print head. The head connector has the connector body made of a hard insulating material, such as a hard synthetic resin, and includes a plurality of terminal metal parts protruding from the connector body. On the other hand, in the line type thermal print head, there are provided through-holes at positions corresponding to the terminal metal parts. The head connector is fixed to the line type thermal print head after its terminal metal parts are inserted into the through-holes of the print head by soldering. In this arrangement, it is necessary to provide the through-holes in the line type thermal print head, and insert the protruding ends of the terminal metal parts into the through-holes. This has been troublesome and a considerably wide space has been required for mounting the head connector.

In a system proposed in Japanese Patent Laid-Open Publication Nos. Hei 6-246948 and Hei 6-267620 (Related Art 2), a terminal metal part protrudes from a connector body made of an insulating material, such as a hard synthetic resin as shown in FIG. 13. In FIG. 13, reference numeral 301 denotes a head circuit board, 303 a head connector, 305 a connector body, and 307 a terminal metal part. The terminal metal part is mounted so as to protrude in a direction toward the surface of the circuit board of the print head (in parallel with the surface of the circuit board). The protruding part of the terminal metal part is shaped in a bifurcated form. The bifurcated portions of the terminal metal parts are fitted over the side edge of the print head. As the terminal metal parts clasp the side edge portion of the print head, the head connector is mounted. In contrast to the conventional system, in this system the head connector can be mounted easily and a smaller space is required for mounting the connector.

However, in spite of the advantage mentioned above, the system of Related Art 2 has the following problem. In the above system, the bifurcated portions of the terminal metal parts protrude from one side of the connector body, the head connector is mounted to the line type thermal print head using only the bifurcated portions. Therefore, it is not easy to mount the head connector in a stable condition, to secure sufficient mounting strength or prevent the head connector from becoming shaky.

Further, in the above system, the direction of fitting the terminal metal parts of the head connector on the line type thermal print head is in the direction of the flat surface of the circuit board. In other words, this fitting direction is the direction in which the terminal metal parts protrude from the connector body. On the other hand, the direction of inserting and removing the external wires (or the terminal connector of external wires) to and from the head connector is generally the same as the protruding direction of the terminal metal parts. Therefore, when inserting or removing the external wires to or from the head connector, it is necessary to take care that the head connector does not come off the print head. There has been demand for a line type thermal print head system without a possibility of the connector coming off.

DISCLOSURE OF THE INVENTION

The present invention has been made with a technical object of providing a line type thermal print head which can solve the above problems, and has been adapted to improve printing quality by reducing a printing density difference, and facilitate connection of external wires to the connector.

To achieve the above object, a line type thermal print head according to the present invention comprises a head circuit board; a heating resistor extending in a line on the surface of the head circuit board; a common wiring pattern extending along the heating resistor and conducting to those portions of the heating resistor which correspond to respective print dots; a plurality of individual circuits formed in the area opposite the common wiring pattern across the heating resistor on the surface of the head circuit board, and conducting to those portions of the heating resistor which correspond to the respective dots; a ground wiring pattern extending along the heating resistor on the surface of the head circuit board, and connected to the individual circuits through a plurality of driver elements; a ground connection terminal provided substantially in the center of a side edge portion on the side of the ground wiring pattern with respect to the heating resistor on the surface of the head circuit board, and conducting to substantially the central portion in the linear direction of the ground wiring pattern; and a pair of the common-wiring connection terminals provided in the side edge portion, and conducting to both ends of the common wiring pattern.

As described above, in the present invention, the ground wiring pattern is not divided substantially at the central portion into right-side and left-side portions. The ground connection terminal is formed substantially at the center of the side edge portion of the head circuit board, and conducts to substantially the central portion in the longitudinal direction of the ground wiring pattern. By this arrangement, electric power for printing can be supplied through the ground connection terminal to both the right-side portion and the left-side portion of the ground wiring pattern simultaneously. The power supplied to the right-side portion and the power supplied to the left-side portion can move from one side to the other side. Therefore, when printing is come out using the overall length of the ground wiring pattern, a voltage difference is positively prevented from occurring between the right-side portion and the left-side portion of the ground wiring pattern. For example, even if the number of dots used for printing differs between the right-side portion and the left-side portion of the ground wiring pattern, the above-mentioned voltage difference on the ground wiring pattern does not occur.

Therefore, according to the present invention, the following effects can be obtained. In the present invention, for the same reason as in Related Art 1 mentioned above, the voltage difference between the common wiring pattern and the ground wiring pattern can be reduced. More specifically, since the ground connection terminal is made to conduct to substantially the central portion of the ground wiring pattern and a pair of common-wiring connection terminals is connected to both ends of the common-wiring pattern, the voltage difference between the common wiring pattern and the ground wiring pattern is maintained substantially at a fixed level along the longitudinal direction. Moreover, as described above, the voltage difference between the right-side portion and the left-side portion of the ground wiring pattern can be decreased. Altogether, the printing density in the whole printing range can be made substantially uniform, thereby greatly improving printing quality.

According to a preferred aspect of the line type thermal print head in the present invention, the pair of common connection terminals are arranged in the line direction at outside positions across the ground connection terminal. In this arrangement, the ground connection terminal and both common connection terminals can be arranged to extend up to the side edge of the head circuit board. Therefore, those connection terminals can be simply, easily and positively connected to external wires, a connector for external wires, or the like. In addition, a short-circuit in the terminals can be simply and absolutely prevented.

On the other hand, the present invention has been made with a technical object of providing a line type thermal print head system adapted to solve the above-mentioned problems, and is structured to improve the mounting strength of the head connector to the line type thermal print head by use of a simple structure, and to preclude the possibility of coming off the head connector when inserting or removing external wires, or the like.

In order to achieve the above objects, the line type thermal print head system according to the present invention comprises a line type thermal print head, and a head connector mounted on the line type thermal print head, wherein the line type thermal print head includes connection terminals arranged on the side edge, wherein the head connector includes a connector body made of a hard insulating material, such as a hard synthetic resin, and when mounted, being in contact at a contact surface thereof with the reverse surface of the line type thermal print head, and a plurality of terminal metal parts provided in a row at positions corresponding to the respective connection terminals in such a manner as to extend from the contact surface of the connector body, and wherein a clasp portion of each terminal metal part is formed by bending sideways the protruding end portion of the terminal metal part and the line type thermal print head is held between the clasp portion and the contact surface of the connector body of the head connector.

With this arrangement, the connector body at its contact surface directly contacts the reverse surface of the line type thermal print head, and is pressed to the reverse surface by the elastic force of the clasp portion. Thus, the connector head can be mounted stably, reliably and firmly without leaving a possibility of becoming loose.

Each terminal metal part extends, for example, in a direction substantially at right angles to the top surface of the line type thermal print head. The clasp portion is formed by bending the protruding portion of each terminal metal part sideways. The direction of mounting the head connector to the print head is in the direction of the flat surface of the head circuit body. On the other hand, the direction of inserting and removing external wires (or the connector of external wires) to and from the head connector is the protruding direction of the terminal metal part from the connector body. Therefore, the mounting direction of the head connector differs from the inserting and removing direction of external wires. For this reason, when inserting or removing external wires or the external terminal to or from the head connector, the chances of the head connector coming off the line type thermal print head are greatly reduced.

Moreover, by the elastic force of the clasp portion of each terminal metal part, the line type thermal print head is pressed to the contact surface of the connector body. By this pressing action, the warpage of the line type thermal print head can be rectified.

In another aspect of the present invention, recesses for mounting terminal metal parts are provided in the contact surface of the connector body, wherein each recess for mounting terminal metal part extends in the longitudinal direction of the clasp portion, and each terminal metal part extends from the recess for mounting a terminal metal part. By this arrangement, the elasticity of the clasp portions can be increased under the condition that the clasp portions are prevented from being bent sideways. Also, it is easy to insert the side edge of the print head between the connector body and the clasp portions. Moreover, the provision of the recesses in the contact surface of the connector body increases the contact pressure of the contact surface to the print head. Therefore, the mounting strength of the head connector to the print head can be further improved.

Furthermore, according to yet another aspect of the present invention, a row-direction groove extending in the row direction of the terminal metal parts is formed in the contact surface of the connector body, the press-contact parts of the clasp portions to the line type thermal print head are located so as to face the row-direction groove. With this arrangement, the contact pressure of the contact surface of the connector body to the line type thermal print head can be increased. Since the pressing force of each clasp portion is received by the contact surfaces across the row-direction groove, the mounting strength and the stability of the head connector can be further augmented.

BEST MODE FOR CARRYING OUT THE INVENTION (1) First Embodiment

Figure 1:
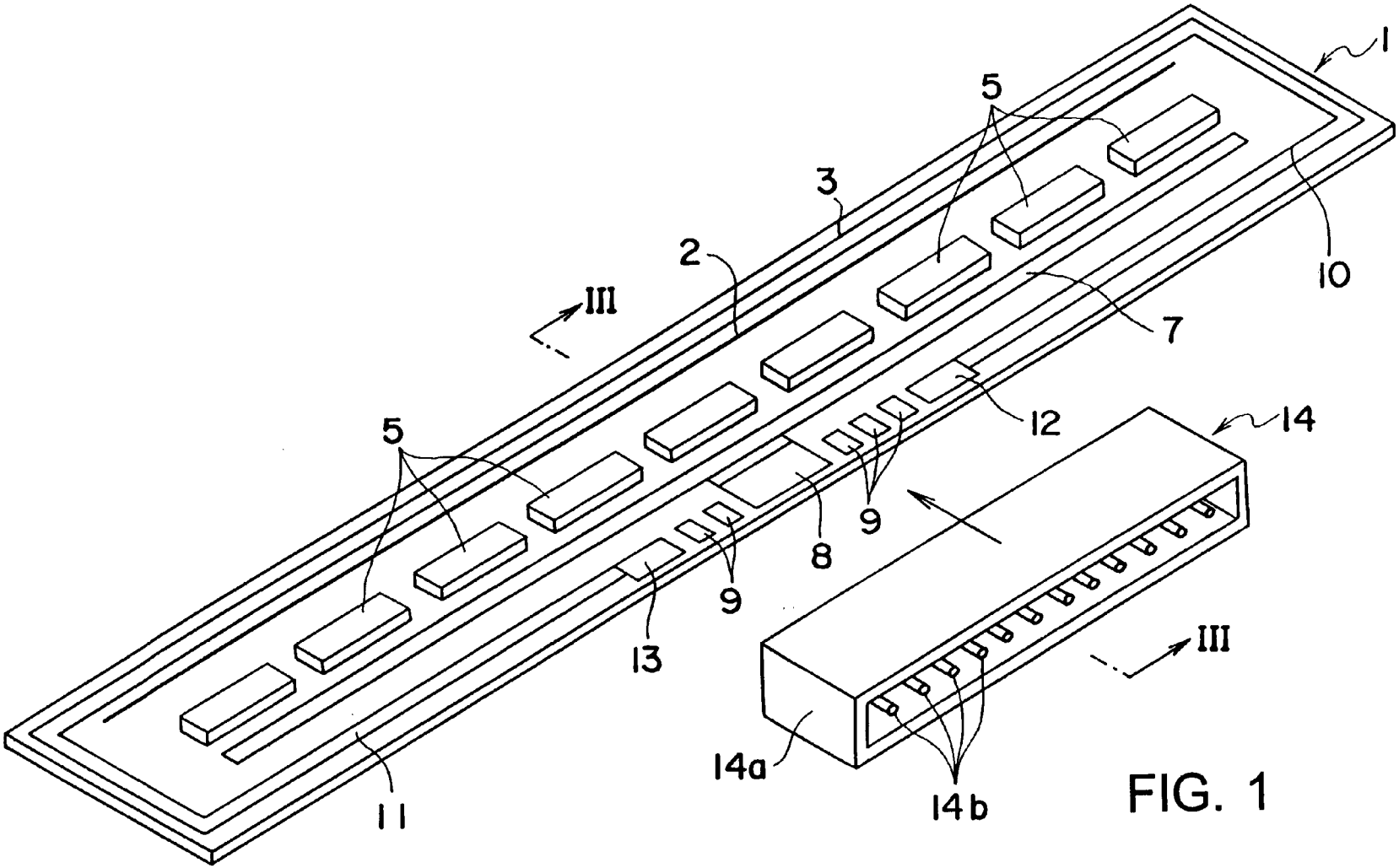
FIG. 1 is a perspective view of the whole of the line type thermal print head according to a first embodiment of the present invention.

A first embodiment of the present invention will be described with reference to FIGS. 1 to 3. In FIG. 1, reference numeral 1 denotes a head circuit board formed in a rectangular shape and of a heat-resistant insulating material, such as a ceramic material. On the top surface of the head circuit board, there is formed a heating resistor 2 in a straight line substantially in parallel with one side edge 1*a* of the head circuit board 1, and the heating resistor 2 has those portions which correspond to a plurality of print dots. A common wiring pattern 3 is formed on that part of the top surface of the head circuit board 1 which is close to the one side edge 1*a* parallel with the heating resistor 2. The common wiring pattern 3 is formed extending along the heating resistor 2, and conducts to those portions of the heating resistor 2 which correspond to the respective print dots.

Figure 2:
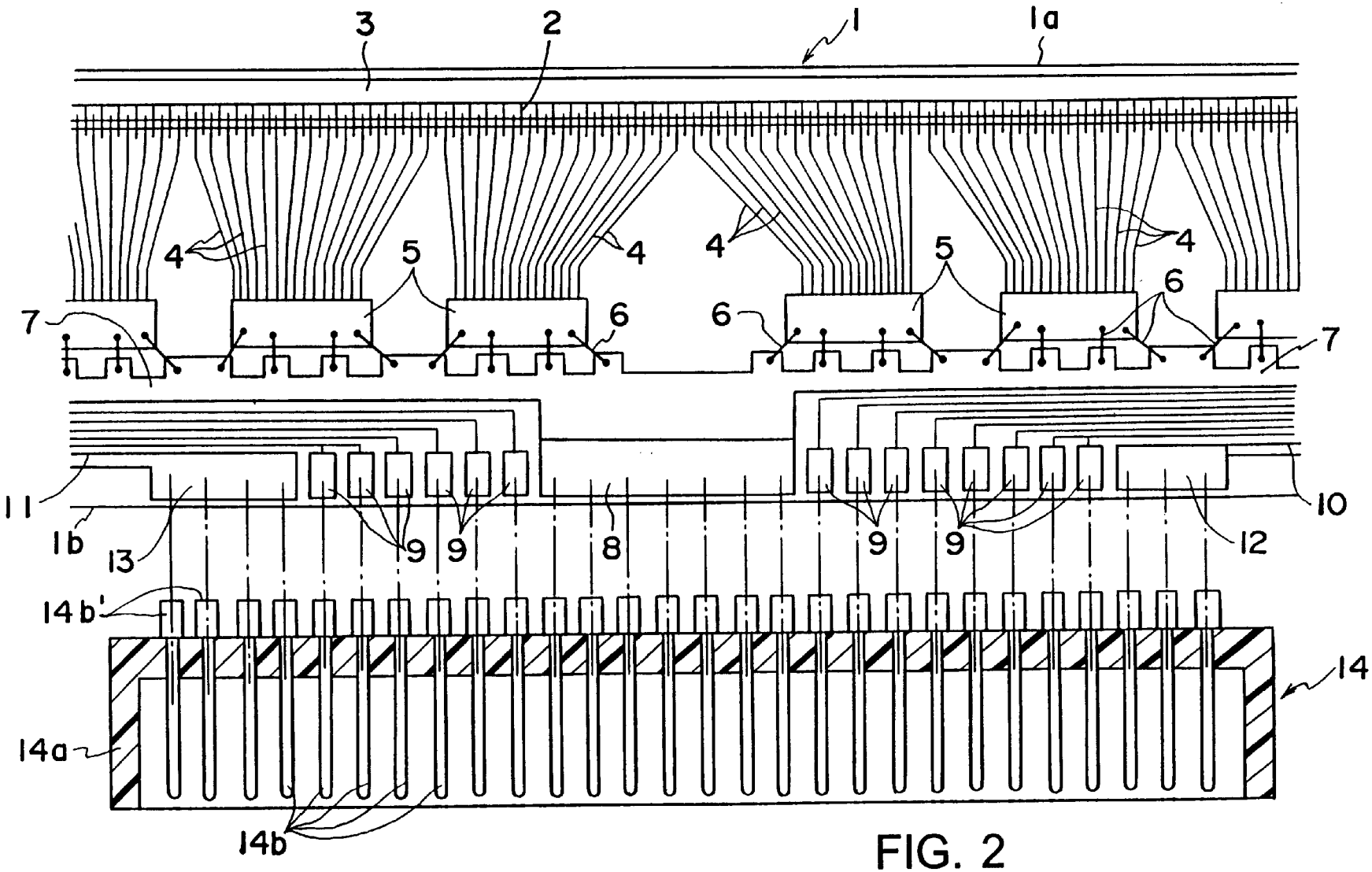
FIG. 2 is a plan view of a principal part, on an enlarged scale, of the line type thermal print head in FIG. 1.

As shown in FIG. 2, a plurality of individual microcircuits are patterned in that area on the top surface of the head circuit board 1 which is opposite from the common wiring pattern 3 across the heating resistor 2. The patterned individual circuits 4 conduct to the portions of the heating resistor 2 which correspond to the respective print dots. A plurality of driver elements 5 conducting to the patterned individual circuits 4 are mounted in a line along the heating resistor 2.

Provided between the driver elements 5 and the other side edge 1*b* (the side edge opposite from the one side edge 1*a*) of the top surface of the head circuit board 1 is a ground wiring pattern 7, which is formed extending substantially in parallel with the row of driver elements 5. The ground wiring pattern 7 conducts through metal wires 6, connected by wire bonding, to the respective driver elements 5.

A ground connection terminal 8 with a wide width is formed substantially in the central part in the longitudinal direction of, and close to, the other side edge 1*b* of the top surface of the head circuit board 1. This ground connection terminal 8 conducts to substantially the central portion in the longitudinal direction of the ground writing pattern 7. A plurality of signal connection terminals 9 for supplying various signals to the driver elements 5 are formed on both sides across the ground connection terminal 8. A pair of common-wiring connection terminals 12, 13 wide in width are formed on both sides across the connection terminals 9. The pair of common-wiring connection terminals 12, 13 conduct through the common-wiring connection circuits 10, 11 to each end of the common wiring pattern 3.

The line type thermal print head arranged as described above operates in the same manner as the conventional print head under the condition that it is mounted on the printer of a facsimile or the like. More specifically, when a driver element 5 switches from one circuit to another, an arbitrary one of the individual circuits 4 is electrically connected to the ground wiring pattern 7, so that the portion of the heating resistor corresponding to the conducting individual microcircuit 4 generates heat. Consequently, printing is performed at the print dot according to the heat generated.

In this embodiment, the ground wiring pattern 7 is not divided about the center into left-side and right-side portions. The ground connection terminal 8 broad in width is connected to about the center in the longitudinal direction of the ground wiring pattern 7. Therefore, electric power for printing can be simultaneously supplied to the left-side and right-side portions of the ground wiring pattern 7 through the ground connection terminal 8. Also, the power supplied to the right-side portion and the power supplied the left-side portion can move from one side to the other. For this reason, when printing takes place for the overall length of the ground wiring pattern 7, even if the number of dots used for printing differs between the right-side and the left-side portion of the ground wiring pattern 7, a voltage difference is prevented from occurring between the left-side and right-side portions.

Furthermore, in this embodiment, the ground connection terminal 8 is located substantially in the center of the ground wiring pattern 7. Both common-wiring connection terminals 12, 13 are located at outside positions with respect to the ground connection terminal 8. Therefore, the ground connection terminal 8 as well as both common-wiring connection terminals 12, 13 can be extended up to the other side edge 1*b* of the head circuit board 1 as shown in FIG. 2. In other words, in contrast to Related Art 1, when the ground connection terminal 8 is mounted by extending it up to the other side edge 1*b*, there is no chance of its being interfered with the common-wiring connection circuits 10, 11. Accordingly, it becomes easy to mount the connector to the head circuit board 1 and cause the connection terminals to conduct to the connector.

Figure 3:
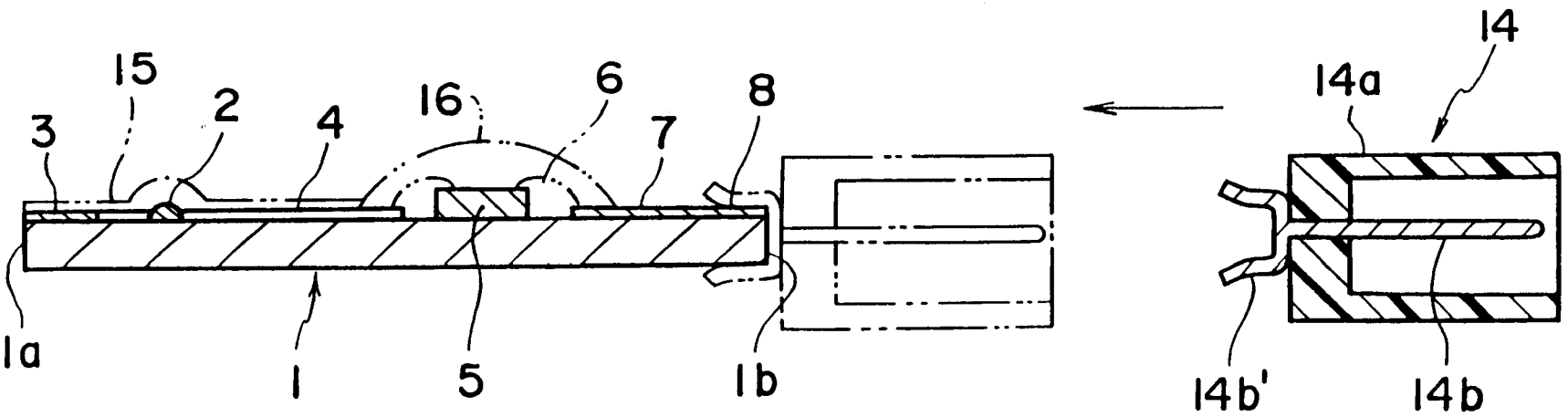
FIG. 3 is a sectional view, on an enlarged scale, taken along the line III—III in FIG. 1.

For example, according to this embodiment, a connector 14 for external connection as shown in FIG. 3 can be used to facilitate connection to external wiring. The connector 14 is complete with a plurality of terminal pins 14*b* fixed in a box 14*a*. Each terminal pin 14*b* of the connector 14 has a bifurcated gripper 14*b*', which is fitted on the other side edge 1*b* of the head circuit board 1. Thus, the connector 14 is mounted to the head circuit board 1, so that the terminal pins 14*b* are electrically connected to the ground connection terminal 8, the connection terminals 9 of various signals, or the common-wiring connection terminals 12, 13.

According to this embodiment, seven terminal pins 14*b* are connected to the ground connection terminals 8, three terminal pins 14*b* to one common-wiring connection terminal 12, and four terminal pins 14*b* to the other common-wiring connection terminal 13. The bifurcated gripper 14*b*' of each terminal pin 14*b* is fitted on the other side edge 1*b* of the head circuit board 1, and then fixed by soldering or with an electrically conductive paste.

In a modification of this embodiment, various external wires may be directly connected to the ground connection terminal 8, connection terminals 9 for various signals, and both common-wiring connection terminals 12, 13.

As described above, according to this embodiment, the ground connection terminal 8, the connection terminals 9 for various signals, and both common-wiring connection terminals 12, 13 are extended up to the other side edge 1*b* of the head circuit board 1. Therefore, this arrangement enables those connection terminals to be connected simply, easily and firmly to various external wires, a connector for external connection or the like. This effect will become more apparent by comparing the above-mentioned arrangement with the case where there are the common-wiring connection circuits between the ground connection terminal and the other side edge of the head circuit board as in Related Art 1 mentioned above.

In addition, the heating resistor 2, a glass coating 15 covering the common wiring pattern 3 and the individual circuits 4, and a resin coating covering the driver elements 5 are formed on the top surface of the head circuit board 1, as shown in FIG. 3 with a two short and one long dashed line.

(2) Second Embodiment

The line type thermal print head system according to a second embodiment of the present invention will be described with reference to FIGS. 4 to 11.

Figure 4:
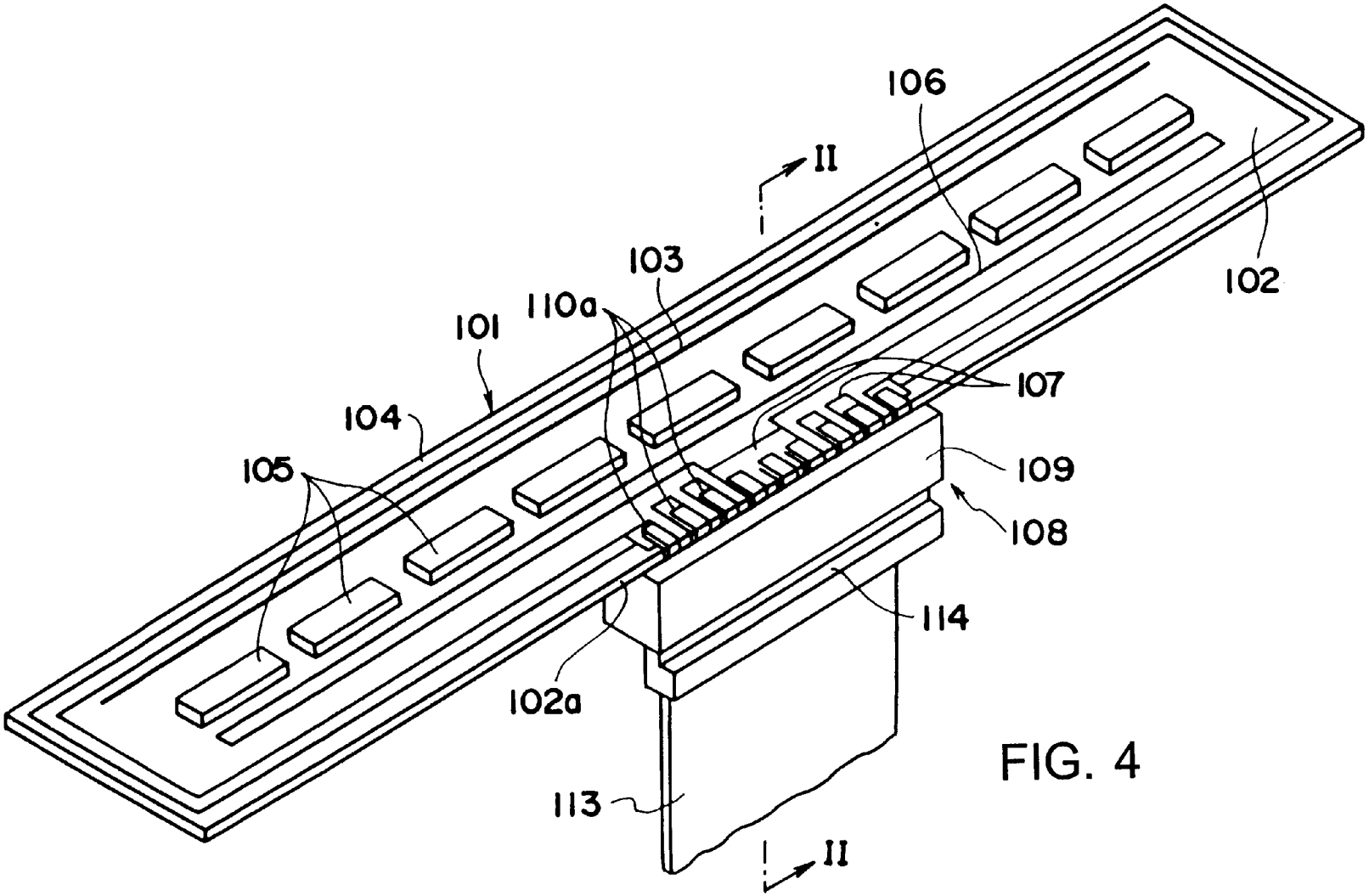
FIG. 4 is a perspective view of the whole of the line type thermal print head system according to a second embodiment of the present invention in which a head connector is mounted on the line type thermal print head.

In FIG. 4, reference numeral 101 denotes a line type thermal print head of the same composition as in the first embodiment. More specifically, in this line type thermal print head 102, linear heating resistor 103, a common wiring pattern 104 conducting to the heating resistor 103, a plurality of driver elements 105, and a ground wiring pattern 106 are formed on the top surface of a ceramic head circuit board 102. Furthermore, a plurality of terminal electrodes 107 corresponding to the common wiring pattern 104, the ground wiring pattern 106, and the driver elements 105 are formed on that portion of the top surface of the head circuit board 104 which is adjacent to one side edge 102*a*. In other words, the terminal electrodes 107 includes the ground connection terminal 8, the signal connection terminals 9, and the common-wiring connection terminals 13, 14 in the first embodiment.

Reference numeral 108 denotes a head connector mounted to the side edge portion 102*a* of the line type thermal print head 101. The head connector 108 includes a connector body 109, and a plurality of terminal metal parts 110 provided in the connector body 109. The connector body 109 is a box-shaped component made of a hard insulating material, such as a hard synthetic resin, and the terminal metal parts are made of leaf springs and have a substantially U-like configuration as shown in FIG. 4.

Figure 5:
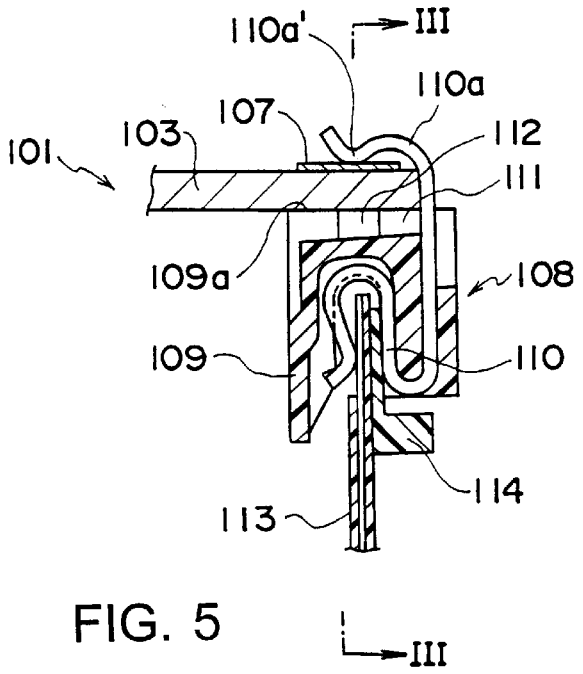
FIG. 5 is a sectional view, taken along the line II—II in FIG. 4.

In FIG. 5, a contact surface as one side face of the connector body 109 is that face which comes into contact with the head circuit board 102 when the head connector is mounted. As is clear from FIG. 5, each terminal metal part 110 extends in a direction substantially at right angles to the contact surface 109*a* when the head connector is mounted, with one end portion of the terminal metal part 110 protruding beyond the contact surface 109*a*. By bending the protruding end portion sideways to the side of the head circuit board 102, a clasp portion 110*a* is formed. The shape of the clasp portion 110*a* is set so that the head circuit board 102 is clasped between the clasp portion 110*a* and the contact surface 109*a* when the head connector 108 is in the mounted state. The shape and the position of the clasp portion 110*a* are set so that the clasp portions 110*a* contact the terminal electrodes 107 on the surface of the head circuit board 102.

A recess 111 is provided at that part of the contact surface 109*a* of the connector body 109 where a terminal metal part 110 is mounted. The recess 111 extends in the longitudinal direction of the clasp portion 110*a*. The terminal metal part 110 is so formed as to extend from the inside of the recess 111.

In addition, a groove 112 is formed on the contact surface 109*a* of the connector body 109 so as to extend in the direction of the row of the terminal metal parts 110. In FIG. 5, the contact portion 110*a*' is that part of each clasp portion 110*a* which contacts the head circuit board 102. In this embodiment, the contact portion 110*a*' is set so as to contact the head circuit board 102 where the contact portion 110*a*', faces the groove 112.

Description will now be made of the method of mounting the head connector 108 to the line type thermal print head 101. The head connector 108 is mounted in the direction of the flat surface on the head circuit board 102. In mounting, the edge portion of the head circuit board 102 is clasped between the contact surface 109*a* of the connector body 9 and the clasp portion 110*a*. The head connector 108 is positioned so that each terminal metal part 110 can contact the corresponding terminal electrode 107. As shown in FIG. 5, in the mounted condition, the terminal metal part 110 is in contact with the head circuit board 102.

A flat part of external wiring is inserted into the connector body 109, and then a key plate 114 is pushed in. Thus, the terminal metal parts 110 are electrically connected to the corresponding wires of external wiring 113.

In this embodiment, the contact surface 109*a* of the connector body 109 is in direct contact with the rear surface of the head circuit board 102, and the contact body 109 is pressed to the head circuit board 102 by elastic force of the clasp portion 110*a* of each terminal metal part 110. Therefore, the head connector 108 is mounted stably and firmly to the head circuit board 102, leaving no possibility of becoming loose.

The connector body 109 is mounted in the direction of the flat surface of the head circuit board 102. On the other hand, the external wiring 113 is inserted into and removed from the connector body 109 is perpendicularly to the head circuit board 102. Hence, the mounting direction of the connector body 109 to the head circuit board 102 and the direction of inserting and removing the external wiring 113 are at right angles to each other. Consequently, there are less chances for the connector body 109 to come off the head circuit board 102.

Moreover, the head circuit board 102 is pressed to the contact surface 109*a* of the connector body 109 by the elastic force of the clasp portion 110*a* of each terminal metal part 110. Therefore, warpage of the head circuit board 102 can be corrected.

Figure 6:
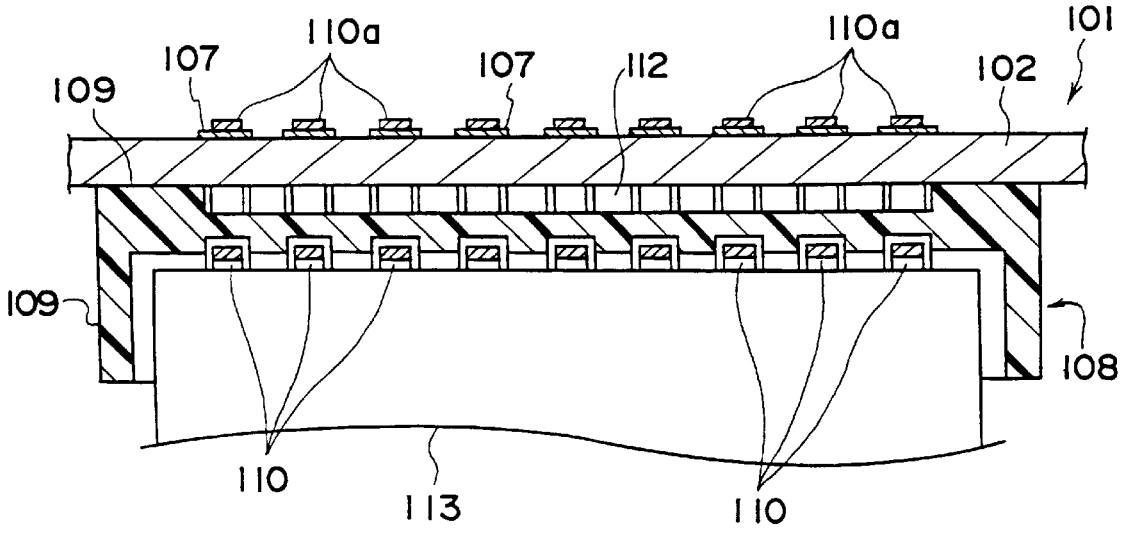
FIG. 6 is a sectional view, taken along the line III—III in FIG. 5.
Figure 7:
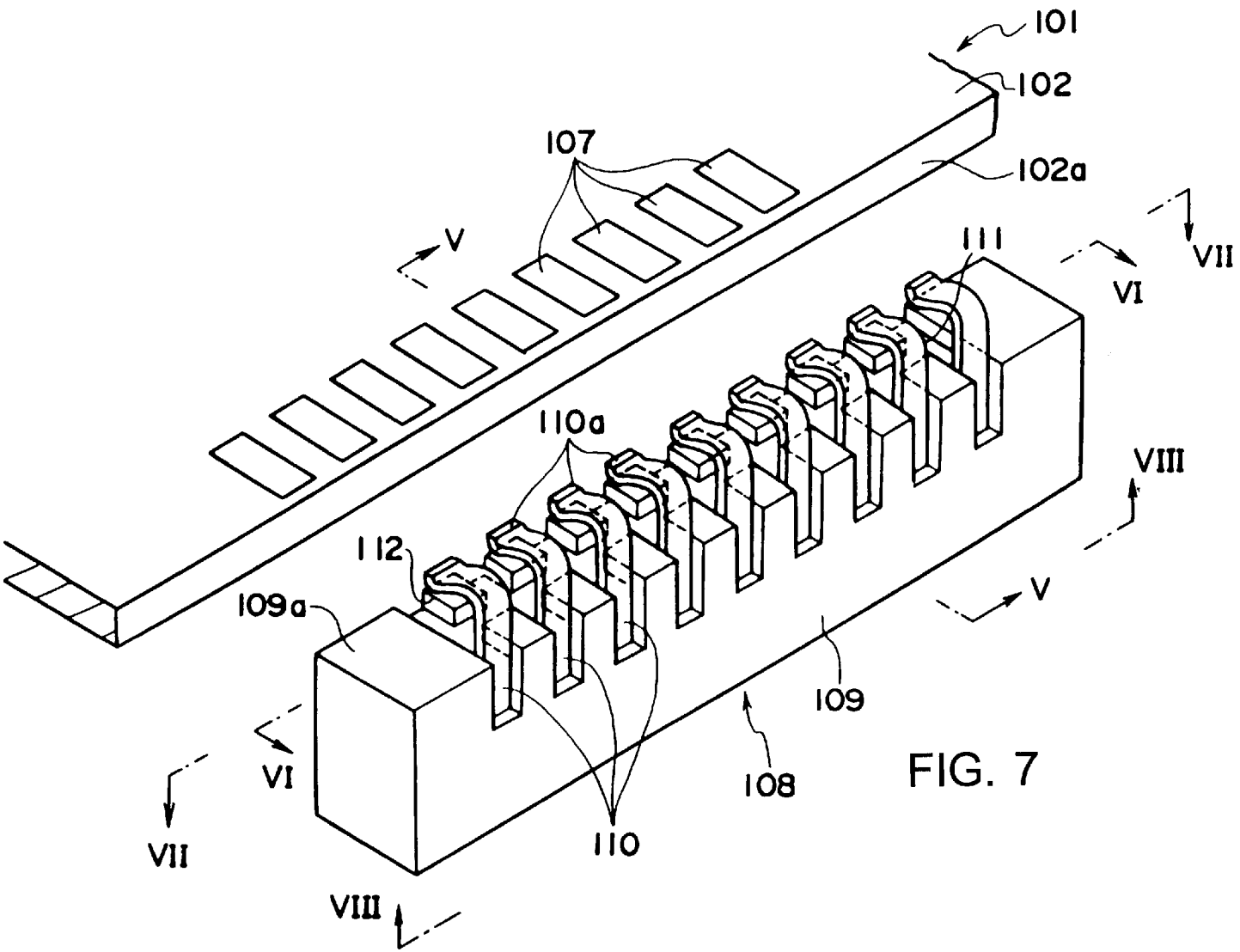
FIG. 7 is a perspective view of the head connector according to a second embodiment.
Figure 8:
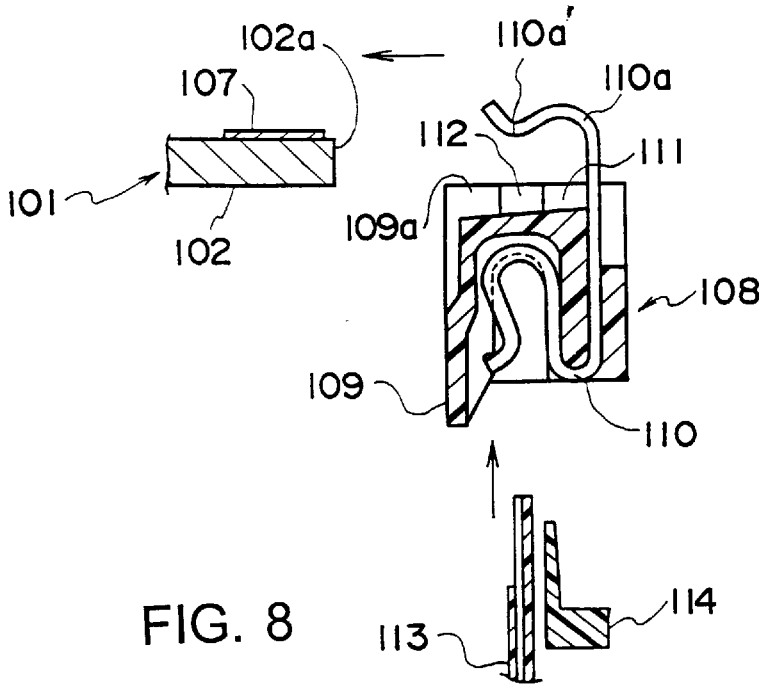
FIG. 8 is a sectional view taken along the line V—V in FIG. 7.
Figure 9:
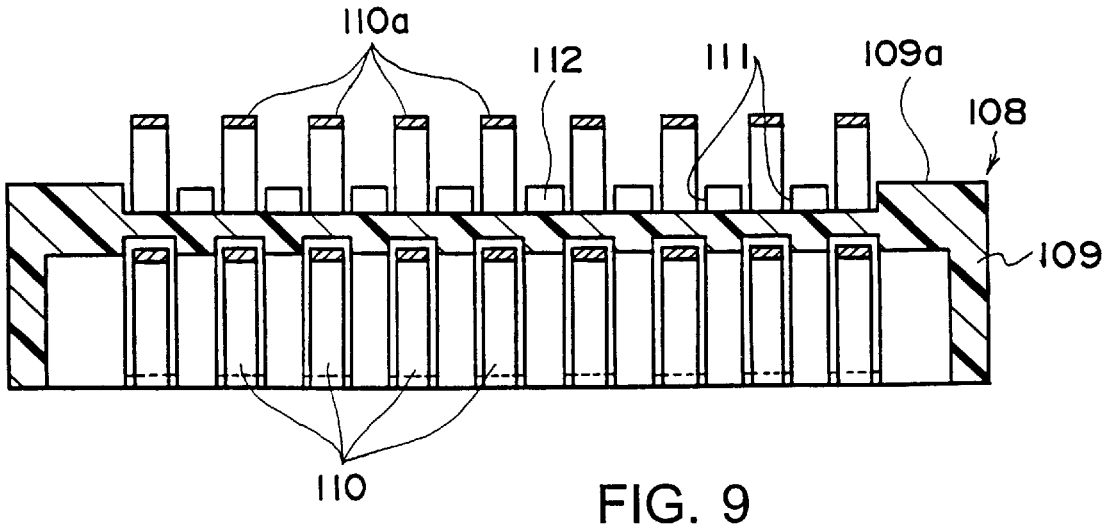
FIG. 9 is a sectional view taken along the line VI—VI in FIG. 7.
Figure 10:
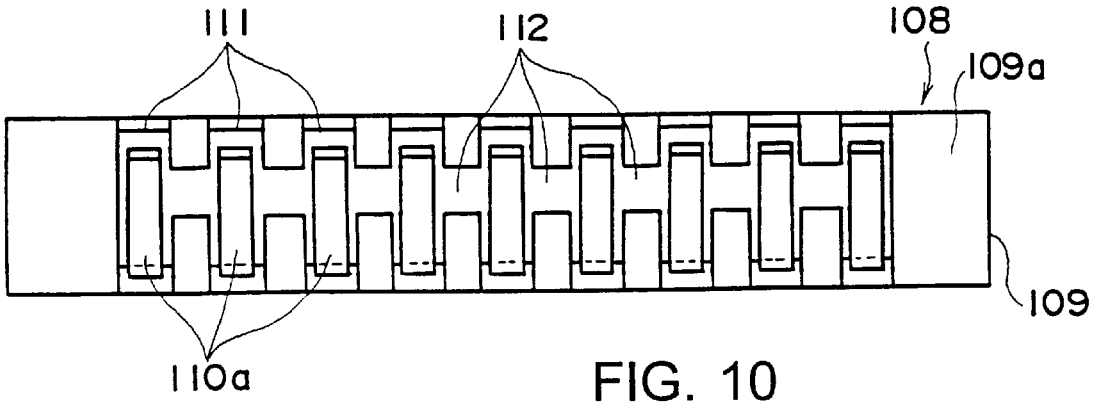
FIG. 10 is a sectional view taken along the line VII—VII in FIG. 7.
Figure 11:
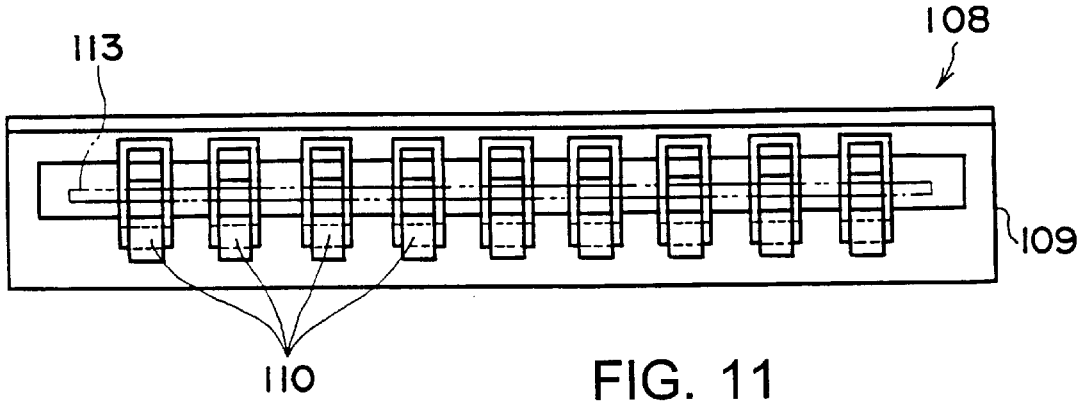
FIG. 11 is a sectional view taken along the line VIII—VIII in FIG. 7.
Figure 12:
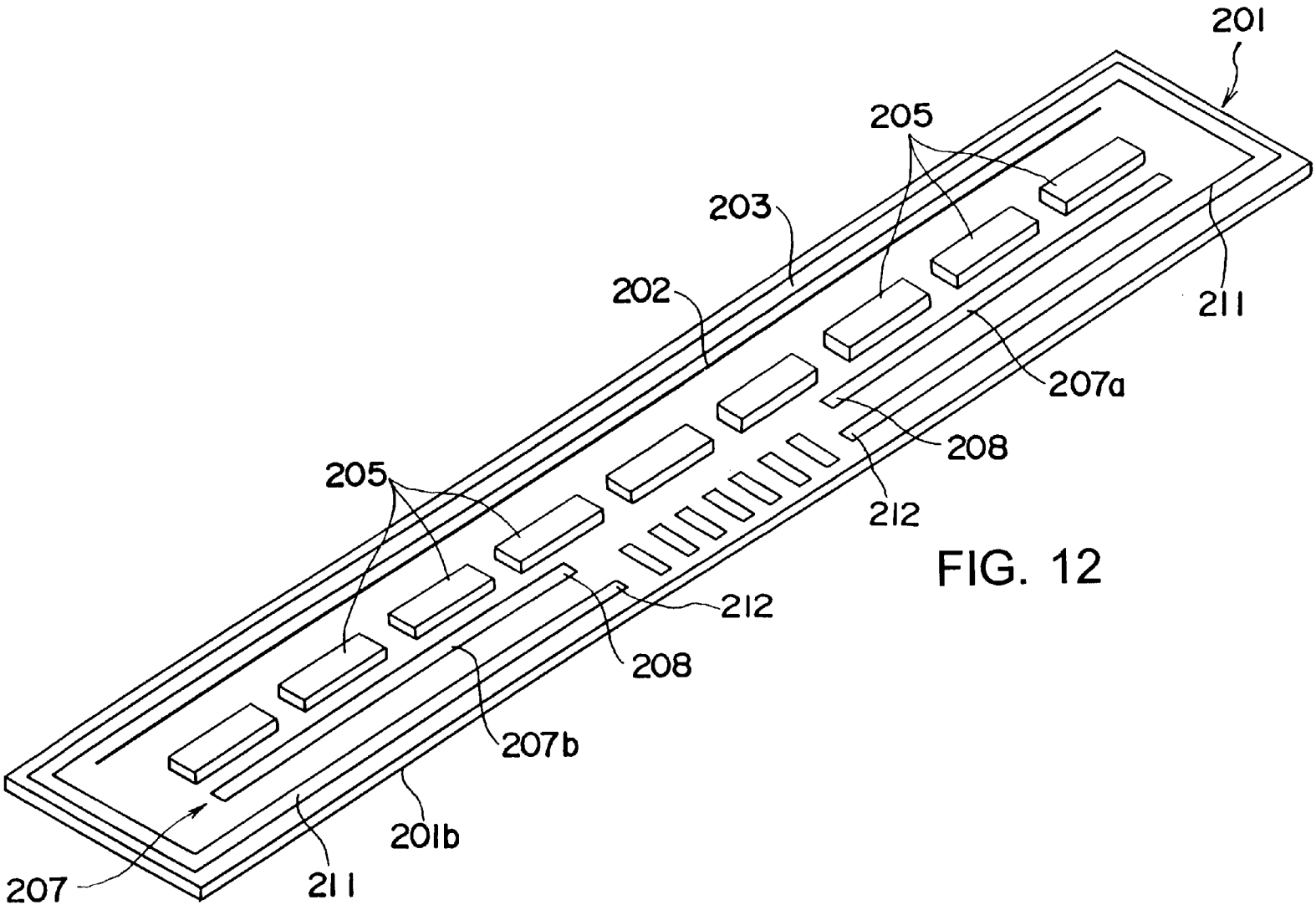
FIG. 12 is a perspective view of the line type thermal print head in Related Art 1.
Figure 13:
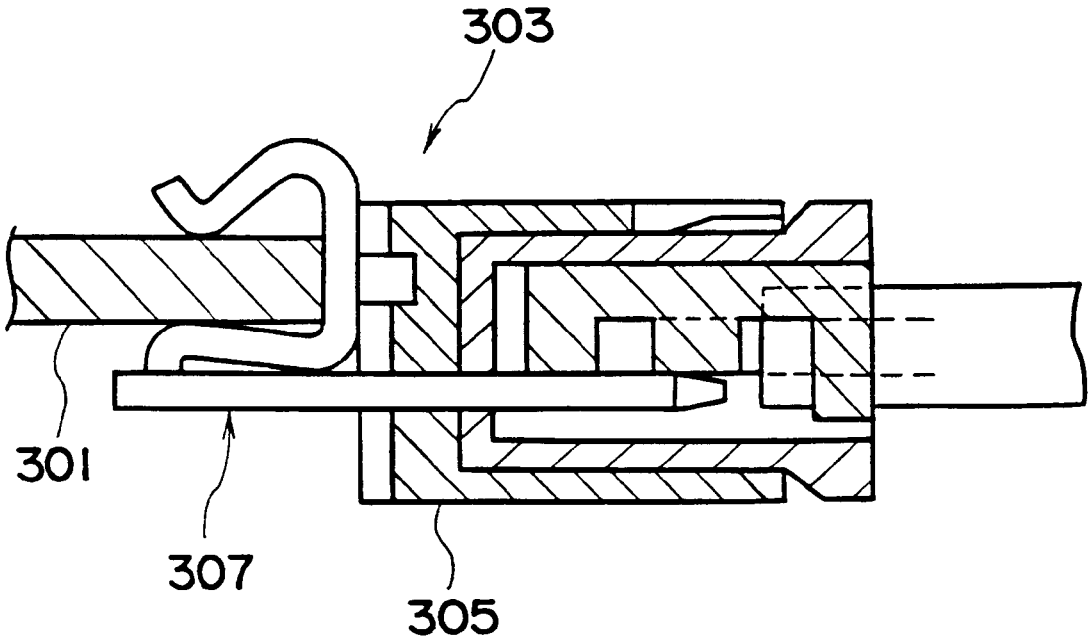
FIG. 13 is a sectional view of the line type thermal print head system in Related Art 2.

Since the wall of the recess 111 is in contact with or close to the terminal metal part 110, the clasp portion 110*a* is prevented from bending sideways (the left-right direction in FIG. 6). Therefore, the head circuit board 102 can be inserted easily between the connector body 109 and each clasp portion 110*a*. Because the sideward bending of the clasp portion 110*a* can be prevented as mentioned above, the elasticity of the clasp portion 110*a* of the terminal metal part 110 can be increased easily. The provision of the recess 111 decreases the area of the contact surface 109*a* of the connector body 109, for which reason the contact pressure between the contact surface 109*a* and the head circuit board 102 is increased. Accordingly, the mounting strength of the head connector 108 can be further increased.

Furthermore, due to the provision of the groove 112, it becomes possible to increase the contact pressure of the contact surface 109*a* of the connector body 109 to the head circuit board 102. The pressing force of each clasp portion 110*a* is supported by the portions other than the groove 112, in other words, by the portions across the groove 112. This promotes the stable, secure and firm attachment of the head connector 108, obviating any chance of the head connector 108 becoming loose.

In this second embodiment, the electrical connection end of each terminal metal part 110 is formed in a U-like configuration, and has the contact end of external wiring electrically connected thereto. However, the present invention can be applied to other modes of operation. For example, the end of each terminal metal part 110 to be connected to external wiring may be formed as a straight pin (male type) connector, and the female connector provided at the end of external wiring may be inserted into the male connector. Conversely, the head connector 108 may be formed as a female type and the connector of external wiring may be formed as a male type.

INDUSTRIAL APPLICABILITY

The present invention can be applied to printers for facsimiles and so on. More specifically, the present invention has wide application as a printer head to be mounted in various types of printers.

What is claimed is:

1. A line type thermal print head assembly comprises a line type thermal print head having a reverse surface and a side edge portion, and a head connector mounted on said line type thermal print head, wherein said line type thermal print head includes:

connection terminals arranged on the side edge portion, wherein said head connector includes:

a connector body made of a hard insulating material, and when mounted, being in contact at a contact surface thereof with the reverse surface of said line type thermal print head; and a plurality of terminal metal parts provided in a row at positions corresponding to said respective connection terminals in such a manner as to extend from the contact surface of the connector body, and wherein a clasp portion of each terminal metal part is formed by bending the protruding end portion of said terminal metal part sideways and the line type thermal print head is held between said clasp portion and the contact surface of said connector body of said head connector.

2. A line type thermal print head assembly according to claim 1, wherein recesses for mounting terminal metal parts are provided in the contact surface of said connector body, and wherein each recess for mounting a terminal metal part extends in the longitudinal direction of said clasp portion, and each terminal metal part extends from the recess for mounting said terminal metal part.

3. A line type thermal print head assembly according to claim 1, wherein a row-direction groove extending in the row direction of said terminal metal parts is formed in the contact surface of said connector body, and wherein press-contact parts of said clasp portions to said line type thermal print head are located so as to face said row-direction groove.

4. The line type thermal print head of claim 1, wherein said head connector has a wire arrangement portion for receiving external wires, and a direction along said contact surface and said clasp portion in which said line type thermal print head is inserted substantially at a right angle to the direction in which said external wires are inserted into said wire arrangement portion.

5. The line type thermal print head assembly of claim 1, wherein the connector body comprises hard synthetic resin.

6. A line type thermal print head assembly including a line type thermal print head and a head connector mounted on said line type thermal print head, wherein said line type thermal print head comprises:

a head circuit board having a surface;

a heating resistor extending in a line on the surface of said head circuit board;

a common wiring pattern extending along said heating resistor and conducting to portions of said heating resistor which correspond to respective print dots;

a plurality of individual printed wires formed on the surface of said head circuit board in an area on an opposite side of said heating resistor to said common wiring pattern, and conducting to those portions of said sets of heating resistor which correspond to said respective print dots;

a ground wiring pattern extending along said heating resistor on the surface of said head circuit board, and connected to said individual printed wires through a plurality of driver elements;

a ground connection terminal provided substantially in the center of a side edge portion on the side of said ground wiring pattern with respect to said heating resistor on the surface of said head circuit board, and conducting to substantially the central portion in a line direction of said ground wiring pattern; and a pair of common-wiring connection terminals in the side edge portion, and conducting to both ends of said common wiring pattern, wherein said head connector includes:

a connector body made of a hard insulating material, which, when mounted, is in contact at a contact surface thereof with a reverse surface of said line type thermal print head; and a plurality of terminal metal parts provided in a row at positions corresponding to said respective connection terminals arranged on the side edge portion of said line type thermal print head in such a manner as to extend from the contact surface of the connector body, and wherein a clasp portion of each terminal metal part is formed by bending the protruding end portion of said terminal metal part sideways and the line type thermal print head is held between said clasp portion and the contact surface of said connector body of said head connector.

7. The line type thermal print head assembly of claim 6 wherein the connector body comprises hard synthetic resin.

* * * * *